US009115939B2

(12) United States Patent
Huazhao et al.

(10) Patent No.: US 9,115,939 B2
(45) Date of Patent: Aug. 25, 2015

(54) MICRO-CHANNEL HEAT EXCHANGER

(71) Applicants: Liu Huazhao, Zhejiang (CN); Wang Feng, Zhejiang (CN); Lin-Jie Huang, East Amherst, NY (US); Gao Yuan, Zhejiang (CN)

(72) Inventors: Liu Huazhao, Zhejiang (CN); Wang Feng, Zhejiang (CN); Lin-Jie Huang, East Amherst, NY (US); Gao Yuan, Zhejiang (CN)

(73) Assignees: Sanhua (Hangzhou) Micro Channel Heat Exchanger Co., Zhejiang Province (CN); Danfoss A/S, Nordborg (DK)

( * ) Notice: Subject to any disclaimer, the term of this patent is extended or adjusted under 35 U.S.C. 154(b) by 0 days.

(21) Appl. No.: 14/060,063

(22) Filed: Oct. 22, 2013

(65) Prior Publication Data

US 2014/0041841 A1 Feb. 13, 2014

Related U.S. Application Data

(62) Division of application No. 12/690,576, filed on Jan. 20, 2010, now abandoned.

(30) Foreign Application Priority Data

Jan. 20, 2009 (CN) ..... 2009 1 0002435

(51) Int. Cl.

| | |
|---|---|
| ***F28D 1/047*** | (2006.01) |
| ***F28F 1/12*** | (2006.01) |
| ***F28D 1/053*** | (2006.01) |
| *F28D 1/02* | (2006.01) |

(52) U.S. Cl.

CPC ..... *F28F 1/126* (2013.01); *F28D 1/05383* (2013.01); *F28D 2001/0266* (2013.01); *F28F 2215/04* (2013.01); *F28F 2260/02* (2013.01)

(58) Field of Classification Search

USPC ..... 165/124, 152, 153, 76

See application file for complete search history.

(56) References Cited

U.S. PATENT DOCUMENTS

| | | | | | |
|---|---|---|---|---|---|
| 892,832 | A * | 7/1908 | Holzerland | ..... | 165/152 |
| 1,184,160 | A * | 5/1916 | Bermann | ..... | 165/153 |
| 1,657,359 | A * | 1/1928 | Hendrix | ..... | 165/153 |
| 2,063,757 | A * | 12/1936 | Saunders | ..... | 165/153 |
| 5,236,336 | A * | 8/1993 | Hitoshi | ..... | 165/153 |
| 5,826,649 | A * | 10/1998 | Chapp et al. | ..... | 165/175 |
| 6,880,620 | B2 * | 4/2005 | Huang et al. | ..... | 165/146 |
| 7,900,689 | B2 * | 3/2011 | Samuelson et al. | ..... | 165/176 |
| 2007/0204977 | A1 * | 9/2007 | Beamer et al. | ..... | 165/124 |
| 2007/0227695 | A1 * | 10/2007 | Beamer et al. | ..... | 165/153 |

FOREIGN PATENT DOCUMENTS

| | | | | | |
|---|---|---|---|---|---|
| JP | 2002243381 | A * | 8/2002 | ..... | F28F 1/30 |
| JP | 2004218852 | A * | 8/2004 | ..... | F28F 1/00 |
| JP | 2005090806 | A * | 4/2005 | ..... | F24F 1/00 |

* cited by examiner

*Primary Examiner* — Leonard R Leo

(74) *Attorney, Agent, or Firm* — McCormick, Paulding & Huber LLP

(57) ABSTRACT

The present invention discloses a micro-channel heat exchanger comprising manifolds, a plurality of micro-channel flat tubes connected to the manifolds, and a plurality of rows of fins spaced apart by the micro-channel flat tubes. The micro-channel heat exchanger is provided with at least one bend designed to avoid the deformation of the fins on two inner sides adjacent to the bend due to crushing and meanwhile maintaining the ventilation and heat exchange functionalities of the bend. For example, the bend may include at least one row of fins where the width of the fins are less than the width of the fins on two sides adjacent to the bend. Alternatively, the gap between the fins in the bend can be greater than the gap between the fins on two sides adjacent to the bend. Still alternatively, the bend can be formed with a space for separating cores of the heat exchanger.

2 Claims, 3 Drawing Sheets

MICRO-CHANNEL HEAT EXCHANGER

CROSS REFERENCE TO RELATED APPLICATIONS

The present application is a divisional application of U.S. patent application Ser. No. 12/690,576 filed Jan. 20, 2010, which is entitled to the benefit of Chinese Patent Application No. 200910002435.9 filed on Jan. 20, 2009, the contents of which are incorporated by reference in their entirety.

TECHNICAL FIELD

The present invention relates to a heat exchanger and more particularly to a micro-channel heat exchanger.

BACKGROUND ART

Compared with the conventional heat exchanger, the micro-channel heat exchanger of the present invention has advantages such as higher heat exchange efficiency and less usage of working medium. Since the industry at present places great emphasis and sets higher requirements on environmental protection and energy conservation, the micro-channel heat exchanger has been widely used in many industries owing to its own advantages, for instance, air-conditioning industry, automobile industry and chemical mechanical industry.

Due to particular design requirements or mounting space constraints, the micro-channel heat exchanger is usually not planar as a whole but designed with one or more bends so as to match the particular mounting space available. In the prior art, some of such bends are formed by bending the micro-channel heat exchanger along the length of a manifold. Fins inside the heat exchanger are crushed, deformed and distorted during the bending process, thereby influencing the heat exchange performance of the heat exchanger and making the appearance of the heat exchanger not aesthetically pleasing. Additionally, the portions of the heat exchanger outside of the bend will be torn where the manifolds are welded to flat tubes, which results in the decrease in the burst pressure of the heat exchanger. For solving the problem of deformation of the fins at bends, the EU patent application No. EP1962040A1 discloses a micro-channel heat exchanger, in which a U-shaped crush relief spacer is disposed at a bend for the purpose of avoiding the deformation of the fins around the bend.

SUMMARY OF THE INVENTION

The object of the present invention is to provide a micro-channel heat exchanger, which can effectively prevent the fins around the bend from deformation when the micro-channel heat exchanger is bent along the length of the manifold.

The micro-channel heat exchanger of the present invention utilizes the following several technical solutions for achieving said object.

Solution 1: a micro-channel heat exchanger comprises manifolds, a plurality of micro-channel flat tubes connected to the manifolds, and a plurality of rows of fins spaced apart by the micro-channel flat tubes, the micro-channel heat exchanger being provided with at least one bend with each having at least one row of fins, the width of the at least one row of fins inside the bend being less than the width of the fins on two sides adjacent to the bend.

Said solution forms a crush stress relief space inside the bend by decreasing the width of the fin inside the bend, thereby avoiding the deformation of the fins on the two inner sides adjacent to the bend due to crushing and meanwhile maintaining the ventilation and heat exchange functionalities of the bend.

Solution 2: a micro-channel heat exchanger comprises manifolds, a plurality of micro-channel flat tubes connected to the manifolds, and a plurality of rows of fins spaced apart by the micro-channel flat tubes, the micro-channel heat exchanger being provided with at least one bend with each having at least one row of fins, the gap between the fins of at least one row among the at least one row of fins being greater than the gap between the fins on two sides adjacent to the bend.

Since the gap of the fins of the bend is greater than the gap of the fins on the two sides adjacent to the bend, when being bent, the fins of the bend will be deformed first as being relatively weak supported, thereby effectively preventing the fins around the bend from being deformed; moreover, since the fins of the bend have comparatively great gaps, they still have big space allowing for air passage after being crushed. Thus, the ventilation and heat exchange functionalities of the bend can be maintained.

Solution 3: a micro-channel heat exchanger comprises manifolds, a plurality of micro-channel flat tubes connected to the manifolds, and a plurality of rows of fins spaced apart by the micro-channel flat tubes, the micro-channel heat exchanger being provided with at least one bend with each having a space for separating a micro-channel heat exchanger core.

The problem of fin deformation is essentially eliminated by arranging a specialized space at the bend because there are no fins and flat tubes in the space and only the manifold is bent upon bending.

Solution 4: a micro-channel heat exchanger comprises manifolds, a plurality of micro-channel flat tubes connected to the manifolds, and a plurality of rows of fins spaced apart by the micro-channel flat tubes, the micro-channel heat exchanger including at least two heat exchanger cores, the manifolds of each heat exchanger core being respectively in sealing connection with the manifolds of another heat exchanger core via elbow pipes, and a bend being formed between the heat exchanger cores.

The solution forms the required bend by interconnecting the heat exchanger cores via elbow pipes, thereby avoiding directly bending the heat exchanger cores. Therefore, fin deformation caused by the bending of the heat exchanger cores is avoided.

DETAILED DESCRIPTION OF THE PREFERRED EMBODIMENTS

Various embodiments of the micro-channel heat exchanger of the present invention will be described in conjunction with the accompanying drawings. It shall be noted that various embodiments described below are only for illustration of the present invention but not intended to limit the present invention.

Figure 1:
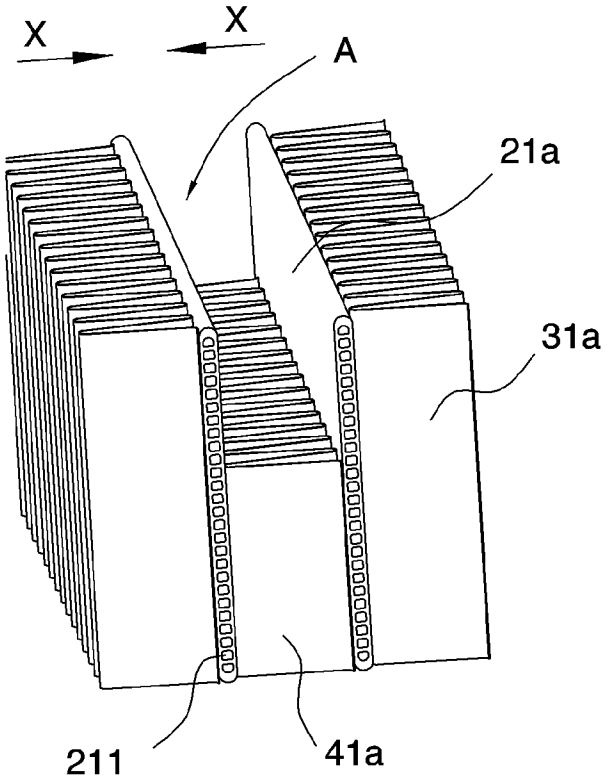
FIG. 1 is a partial perspective view of a first preferable embodiment of the micro-channel heat exchanger of the present invention.

FIG. 1 is a partial perspective view of a first preferable embodiment of the micro-channel heat exchanger of the present invention. A micro-channel heat exchanger in accordance with the present invention typically comprises an upper manifold 11*a*, a lower manifold 12*a* (see FIG. 3), a plurality of micro-channel flat tubes 21*a* respectively connected to the upper manifold 11*a* and the lower manifold 12*a*, and a plurality of rows of fins 31*a* spaced apart by the micro-channel flat tubes 21*a*. Both ends of each micro-channel flat tube 21*a* are respectively inserted into the interiors of the upper manifold 11*a* and the lower manifold 12*a* and are fixed with the upper and lower manifolds 11*a*, 12*a* in sealing connection. The fins 31*a* are fixed onto the micro-channel flat tube 21*a*. As shown more clearly in FIG. 1, the interior of the micro-channel flat tubes 21*a* is provided with a row of micro-channels 211 which extend along the longitudinal direction of the flat tubes 21*a* to two end surfaces of the flat tubes 21*a*. In this embodiment, the upper manifold 11*a*, the lower manifold 12*a* and the micro-channel flat tubes 21*a* are all made of aluminum alloy material.

As shown in FIG. 1, in this embodiment, the micro-channel heat exchanger is provided with a bend which comprises a row of fins 41*a*. The width of the row of fins 41*a* inside the bend is less than the width of the fins 31*a* on two sides adjacent to the bend in such a way that a crush stress relief space A is formed inside the bend. When the micro-channel heat exchanger is bent along the bend in the direction X of the arrows shown in FIG. 1, the flat tubes 21*a* are prone to be close to each other along the direction X since the portions of the flat tubes 21*a* on both sides of the space A are not supported, thereby releasing the crush stress applied on the fins 31*a* in proximity to both sides of the space A. The specific width of the fins 41*a* inside the bend mainly depends on the bending radius, and the width of the fins 41*a* at the bend decreases as the bending radius decreases.

Figure 2:
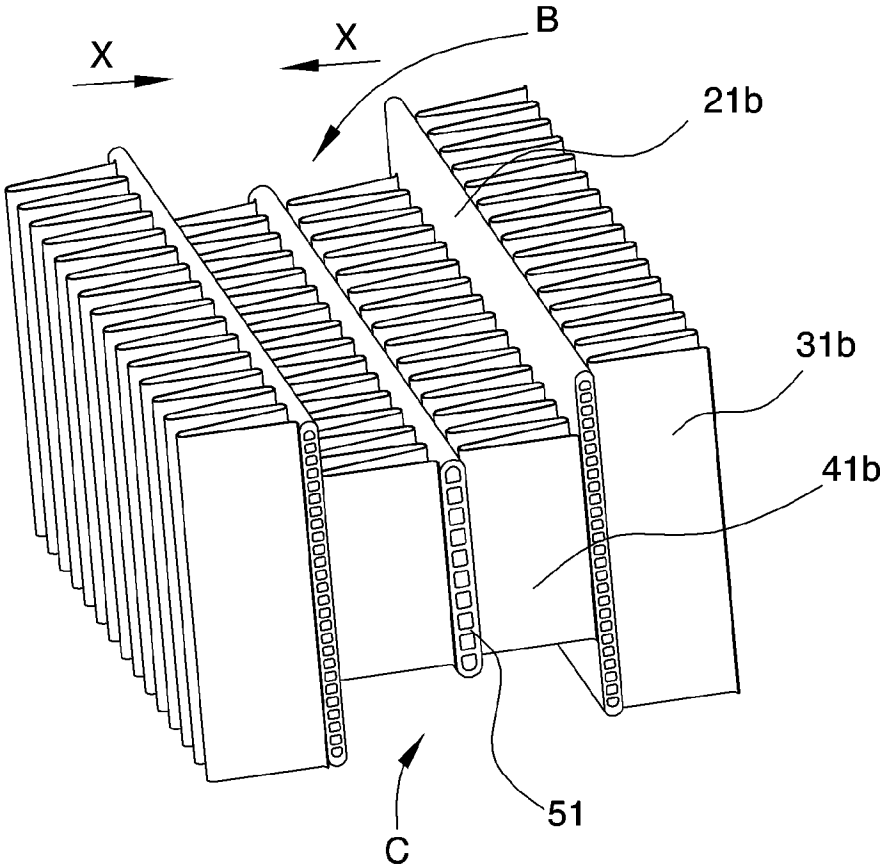
FIG. 2 is a partial perspective view of a second preferable embodiment of the micro-channel heat exchanger of the present invention.

FIG. 2 is a partial perspective view of a second preferable embodiment of the micro-channel heat exchanger of the present invention. Similar to the first embodiment, the micro-channel heat exchanger comprises an upper manifold 11*a*, a lower manifold 12*a* (see FIG. 3), a plurality of micro-channel flat tubes 21*b* respectively connected to the upper manifold 11*a* and the lower manifold 12*a*, and a plurality of rows of fins 31*b* spaced apart by the micro-channel flat tubes 21*b*. As shown in FIG. 2, each bend comprises two rows of fins 41*b* and a flat tube 51 therebetween, the width of the two rows of fins 41*b* inside the bend being less than the width of the fins 31*b* on two inner sides adjacent to the bend and the width of the flat tube 51 inside the bend being less than the width of the flat tubes 21*b* on two inner sides adjacent to the bend, in such a way that a crush stress relief space B is formed inside the bend. When the micro-channel heat exchanger is bent along the bend in the direction X of the arrows shown in FIG. 2, the flat tubes 21*b* are prone to be close to each other along the direction X since the portions of the flat tubes 21*b* on both sides of the space B are not supported, thereby releasing the crush stress applied on the fins 31*b* in proximity to both sides of the space B. In order to make the micro-channel heat exchanger more easily bent so as to avoid the deformation of the fins around the bend, the width of the two rows of fins 41*b* outside the bend is less than the width of the fins 31*b* on two outer sides adjacent to the bend, and the width of the flat tube 51 outside the bend is less than the width of the flat tubes 21*b* on two outer sides adjacent to the bend, thereby forming a space C outside the bend.

Figure 3:
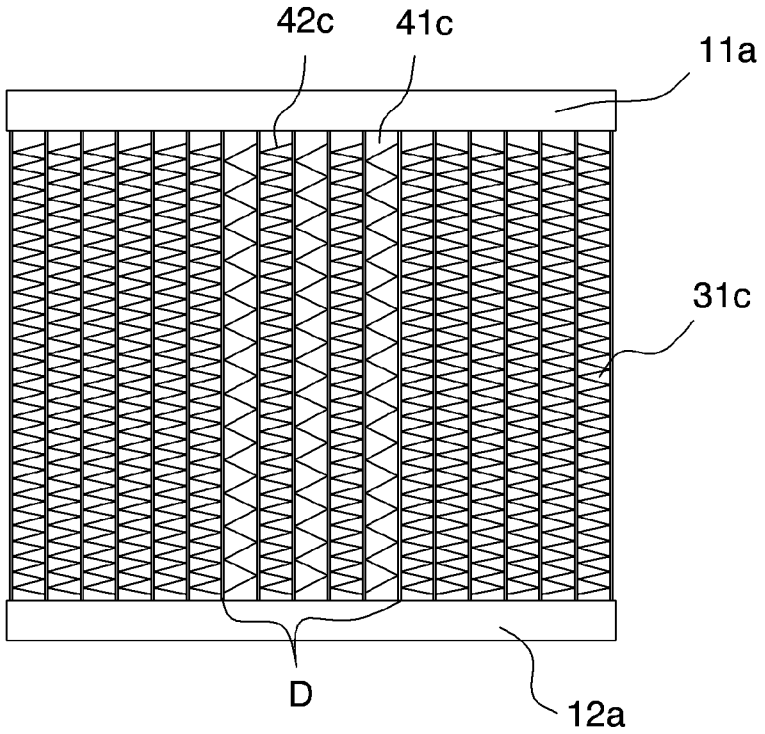
FIG. 3 is a front view of a third preferable embodiment of the micro-channel heat exchanger of the present invention.
Figure 4:
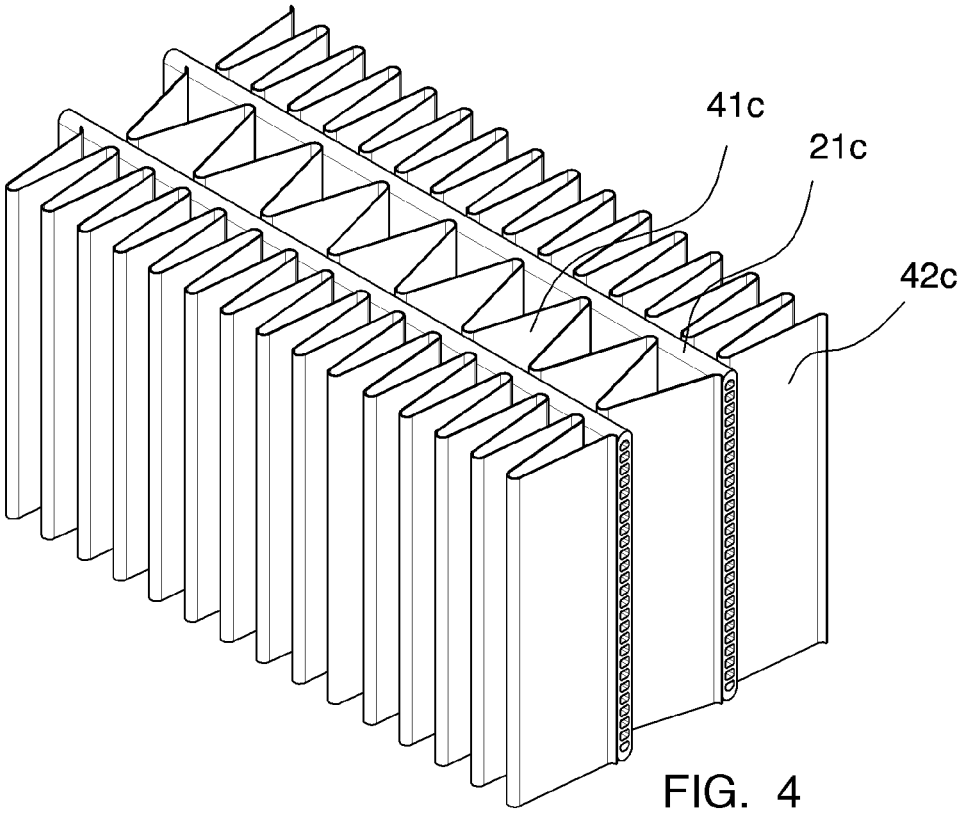
FIG. 4 is a partial enlarged view of the embodiment of FIG. 3.

FIGS. 3 and 4 illustrate a third preferable embodiment of the micro-channel heat exchanger of the present invention. The micro-channel heat exchanger comprises the upper manifold 11*a*, the lower manifold 12*a*, a plurality of micro-channel flat tubes 21*c* respectively connected to the upper manifold 11*a* and the lower manifold 12*a*, and a plurality of rows of fins 31*c* spaced apart by the micro-channel flat tubes 21*c*. As shown in FIG. 3, the bend D comprises five rows of fins, wherein the gap between the fins of three rows of fins 41*c* is greater than the gap between the fins of the rows of fins 31*c* on two sides adjacent to the bend, and the gap between the fins of the remaining two rows of fins 42*c* is the same as that of the rows of fins 31*c*. Certainly, the gap between the fins in the remaining two rows of fins 42*c* may also be the same as that in the rows of fins 41*c* in other embodiments of the present invention. The three rows of fins 41*c* are respectively disposed on both sides of the two rows of fins 42*c* in a spaced manner.

Figure 5:
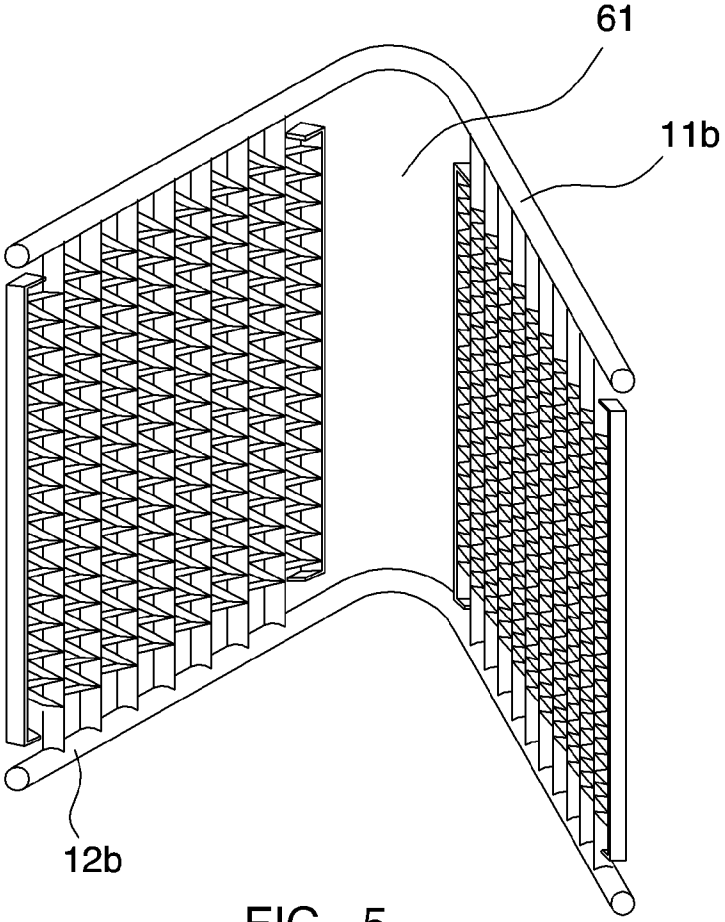
FIG. 5 is a perspective view of a fourth preferable embodiment of the micro-channel heat exchanger of the present invention.

FIG. 5 illustrates a fourth preferable embodiment of the micro-channel heat exchanger of the present invention. As shown in the figure, the micro-channel heat exchanger comprises an upper manifold 11*b* and a lower manifold 12*b*. In this embodiment, the micro-channel heat exchanger is provided with a bend having a space 61 for separating the micro-channel heat exchanger cores. There are no fins and flat tubes arranged in the space 61, and therefore the parts of the upper manifold 11*b* and the lower manifold 12*b* facing the space have no slots for receiving the ends of the flat tubes. Therefore, the bending of the heat exchanger is easier and will not cause the problem of the deformation of the crushed fins when being bent.

Figure 6:
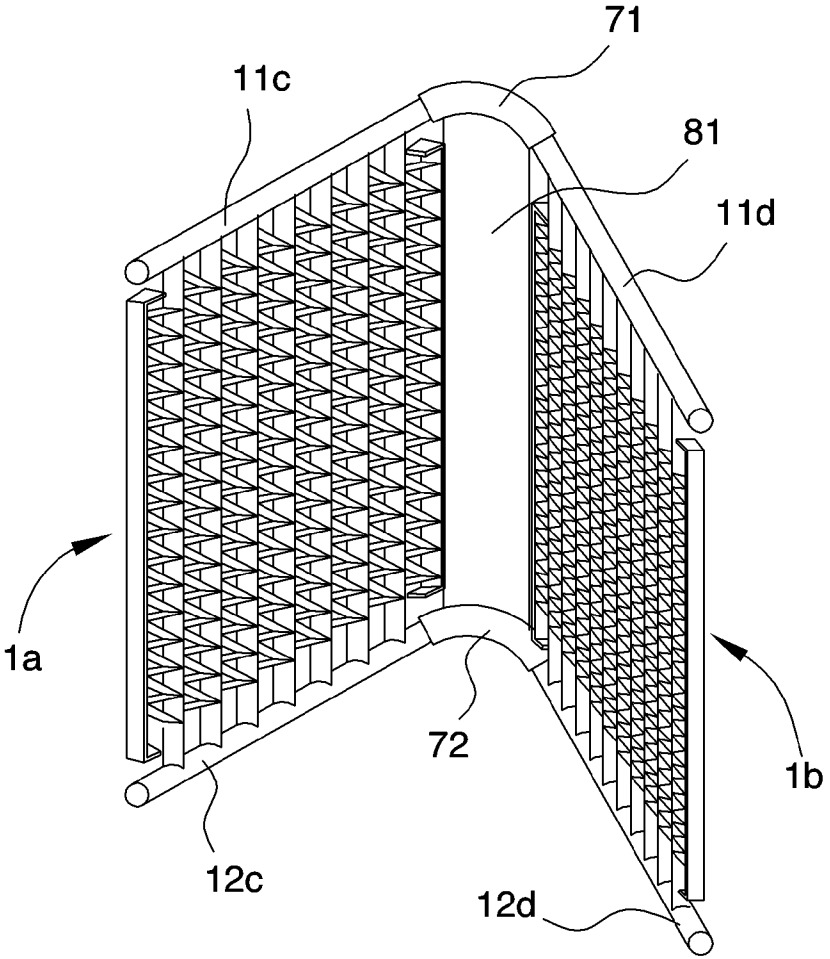
FIG. 6 is a perspective view of a fifth preferable embodiment of the micro-channel heat exchanger of the present invention.

FIG. 6 illustrates a fifth preferable embodiment of the micro-channel heat exchanger of the present invention. As shown in the figure, the micro-channel heat exchanger comprises two heat exchanger cores 1*a* and 1*b*. However, the micro-channel heat exchanger may include three or more heat exchanger cores in other embodiments of the present invention. The heat exchanger core 1*a* comprises an upper manifold 11*c* and a lower manifold 12*c*. Similarly, the heat exchanger core 1*b* comprises an upper manifold 11*d* and a lower manifold 12*d*. An elbow pipe 71 is fitted into one end of the upper manifold 11*c* and the upper manifold 11*d* respectively and sealingly fixed to the two manifolds by welding; likewise, an elbow pipe 72 is fitted onto the lower manifold 12*c* and the lower manifold 12*d* respectively and sealingly fixed to the two manifolds by welding in such a way that a bend is formed between the two heat exchanger cores 1*a* and 1*b*. The elbow pipe 71 is in communication with the upper manifolds 11*c* and 11*d* so that the working medium can flow between the upper manifolds 11*c* and 11*d*. The elbow pipe 72 is in communication with the lower manifolds 12*c* and 12*d* so that the working medium can flow between the lower manifolds 12*c* and 12*d*. The bending radius of the bend can be adjusted by varying the size of the elbow pipes 71 and 72. There forms a gap between the two heat exchanger cores 1*a* and 1*b* connected by the elbow pipes, so a windshield 81 is arranged in the gap for preventing wind from passing the gap. The upper and lower ends of the windshield 81 are respectively fixed onto the elbow pipes 71 and 72 by welding.

The foregoing description of embodiments of the present invention has been presented for the purpose of illustration and description. It is not intended to be exhaustive or to limit the invention to the particular forms disclosed. Obvious modifications and variations are possible in light of the above disclosure without departing from the spirit and scope of the present invention. The embodiments described were chosen to best illustrate the principles of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A micro-channel heat exchanger, comprising manifolds, a plurality of micro-channel flat tubes connected to the manifolds, and a plurality of rows of fins spaced apart by the micro-channel flat tubes, wherein the micro-channel heat exchanger is provided with at least one bend with each bend of the at least one bend having two rows of fins and one flat tube located between the two rows of fins, the width of the two rows of fins inside the bend being less than the width of the fins on two inner sides adjacent to the bend, and the width of the one flat tube inside the bend being less than the width of the flat tubes on the two inner sides adjacent to the bend; wherein the flat tubes and fins on the two inner sides adjacent the bend extend past the two rows of fins and the one flat tube inside the bend both in front of and behind the two rows of fins and the one flat tube inside the bend to form a first space in front of the two rows of fins and the one flat tube inside the bend and a second space behind the two rows of fins and the one flat tube inside the bend.

2. The micro-channel heat exchanger according to claim 1, wherein the width of the fins at the bend shall decrease as a bending radius decreases.

* * * * *